US006645263B2

(12) United States Patent
Keipert et al.

(10) Patent No.: US 6,645,263 B2
(45) Date of Patent: Nov. 11, 2003

(54) CELLULAR ABRASIVE ARTICLE

(75) Inventors: Steven J. Keipert, Somerset, WI (US); John S. Luk, Stillwater, MN (US); Dennis G. Welygan, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 2 days.

(21) Appl. No.: 09/862,357

(22) Filed: May 22, 2001

(65) Prior Publication Data

US 2003/0045213 A1 Mar. 6, 2003

(51) Int. Cl.[7] ..... B24D 3/00; B24D 3/32; B24D 3/34

(52) U.S. Cl. ..... 51/298; 51/296; 51/307; 51/308; 51/309

(58) Field of Search ..... 51/296, 298, 307, 51/308, 309

(56) References Cited

U.S. PATENT DOCUMENTS

| | | | |
|---|---|---|---|
| 2,780,533 | A | 2/1957 | Hurst |
| 2,885,276 | A | 5/1959 | Upton, Jr. |
| 2,972,527 | A | 2/1961 | Upton, Jr. |
| 3,252,775 | A | 5/1966 | Tocci-Guilbert |
| 3,598,772 | A | 8/1971 | Hood et al. |
| 3,607,159 | A | 9/1971 | Haywood |
| 3,915,671 | A | 10/1975 | Kagawa |
| 3,925,034 | A | 12/1975 | Anna et al. |
| 3,982,359 | A | 9/1976 | Elbel et al. |
| 4,035,161 | A | 7/1977 | Geissler et al. |
| 4,086,067 | A | 4/1978 | Busch et al. |
| 4,128,972 | A | 12/1978 | Charvat |
| 4,150,955 | A | 4/1979 | Samuelson |
| 4,253,850 | A | 3/1981 | Rue et al. |
| 4,350,497 | A | 9/1982 | Ogman |
| 4,421,526 | A | 12/1983 | Strickman et al. |
| 4,459,779 | A | 7/1984 | Shen |
| 4,581,287 | A | 4/1986 | Smith et al. |
| 4,799,939 | A | 1/1989 | Bloecher et al. |
| 4,904,280 | A | 2/1990 | Cygan et al. |
| 4,933,373 | A | 6/1990 | Moren |
| 4,938,784 | A | 7/1990 | Murakami et al. |
| 5,250,085 | A | 10/1993 | Mevissen |
| 5,273,558 | A | 12/1993 | Nelson et al. |
| 5,360,873 | A | 11/1994 | Ohkawa et al. |
| 5,492,550 | A | 2/1996 | Krishnan et al. |
| 5,500,273 | A | 3/1996 | Holmes et al. |
| 5,738,697 | A | 4/1998 | Wu et al. |
| 6,465,076 | B2 | 10/2002 | Larson et al. |

FOREIGN PATENT DOCUMENTS

| | | |
|---|---|---|
| EP | 0 008 868 A1 | 3/1980 |

OTHER PUBLICATIONS

Abstract for GB2167076, Koch et al., May 21, 1986.

Abstract for DE4006027, Kausch et al., Aug. 29, 1991.

Principles of Polymer Systems, Second Edition, Ferdinand Rodriguez, p. 464–467, (1982). no month.

U.S. patent application Ser. No. 09/688,486, entitled "Method of Making an Agglomerate Particle", filed Oct. 16, 2000, Culler et al.

U.S. patent application Ser. No. 09/688,484, entitled "An Abrasive Article", filed Oct. 16, 2000, Culler et al.

U.S. patent application Ser. No. 09/688,444, entitled "Method of Making an Abrasive Agglomerate Particle", Oct. 16, 2000, Culler et al.

U.S. Patent Application entitled "Conformable Molded Foam Abrasive Article and Method of Making", filed May 22, 2001, Keipert et al.

*Primary Examiner*—Michael Marcheschi
(74) *Attorney, Agent, or Firm*—Richard Francis; Gregory D. Allen

(57) ABSTRACT

Abrasive articles abrasive articles (e.g., abrasive wheels) comprised of abrasive agglomerate particles dispersed within cellular polymeric material, and methods of making and using the abrasive articles.

14 Claims, 2 Drawing Sheets

CELLULAR ABRASIVE ARTICLE

FIELD OF THE INVENTION

The present invention relates to abrasive articles (e.g., abrasive wheels) comprised of abrasive agglomerate particles dispersed within cellular polymeric material, and methods of making and using the abrasive articles.

DESCRIPTION OF RELATED ART

Abrasive articles comprising abrasive particles coated on and/or dispersed within an organic cellular or foam substrate (e.g., polyurethane) are well known. Examples of such articles include pads, sheets, discs, and wheels (see, e.g., U.S. Pat. Nos. 2,780,533 (Hurst), 2,885,276 (Upton, Jr.), 2,972,527 (Upton, Jr.), and 3,252,775 (Tocci-Guilbert)). These articles have been employed to abrade a variety of workpieces, including metal and wood. They have also been adapted for abrading operations ranging from coarse dimensioning operations such as "snagging" to fine finishing operations such as polishing and buffing.

Abrasive articles comprising abrasive particles dispersed within and/or adhered to a polyurethane cellular or foam matrix have been used, for example, to impart a final refined surface finish on metal (e.g., steel, stainless steel, aluminum, titanium or titanium alloys) substrates designed for use in any of many applications. In finishing such substrates, what is desired is the ability to repeatedly, from part to part, impart a finish to the metal surface, conform to the design features of the metal surface, and not leave residual abrasive article material ("smearing") on the finished metal surface. Current cellular or foam abrasives do not concurrently provide the desired level of each of these features.

SUMMARY OF THE INVENTION

The present invention provides abrasive articles (e.g., an abrasive wheel). Abrasive articles according to the present invention include abrasive articles comprised of abrasive agglomerate particles dispersed within cellular (i.e., having voids dispersed throughout) polymeric material, the abrasive agglomerate particles comprised of abrasive grains and a polymeric matrix formed from a radiation curable polymerizable binder precursor, wherein the abrasive agglomerate particles have a substantially constant cross-sectional area and a crush strength greater than 1 lb. (0.454 kg). Preferably, the polymeric material comprises polyurethane.

Preferably, abrasive articles according to the present invention have at least 25 percent void volume, more preferably, at least 45 percent void volume, and even more preferably have in the range from 50 to 85 percent by void volume.

In another aspect, abrasive articles according to the present invention are preferably further comprised of lubricant (e.g., metallic salts of fatty acids, fatty acid esters, solid lubricants, and mineral oils and waxes, and poly (dimethylsiloxane) gums).

In another aspect, the present invention provides a method of abrading a surface, the method comprising:

providing an abrasive article according to the present invention, the abrasive article having an outer surface;

frictionally contacting at least a portion of the outer surface of the abrasive article with a surface of a workpiece; and moving at least of one the outer surface of the abrasive article or the surface of the workpiece relative to the other to abrade at least a portion of the workpiece surface. The method may include the use of a buffing compound, wherein the buffing compound is on at least a portion of the outer surface of the abrasive article.

Embodiments of abrasive articles according to the present invention are preferably flexible, conformable, and lightweight. Preferred abrasive wheels according to the present invention can be run smoothly and exhibit less "chatter" than conventional abrasive wheels. Further, preferred abrasive wheels according to the present invention can utilize less abrasive grain material than conventional abrasive wheels. Preferred abrasive articles according to the present invention also tend not to "smear" during use. Smearing, which is typically undesirable, can occur when a workpiece in contact with an abrasive article becomes sufficiently hot such that portions of the abrasive article soften and transfer to the workpiece.

DETAILED DESCRIPTION

Figure 1:
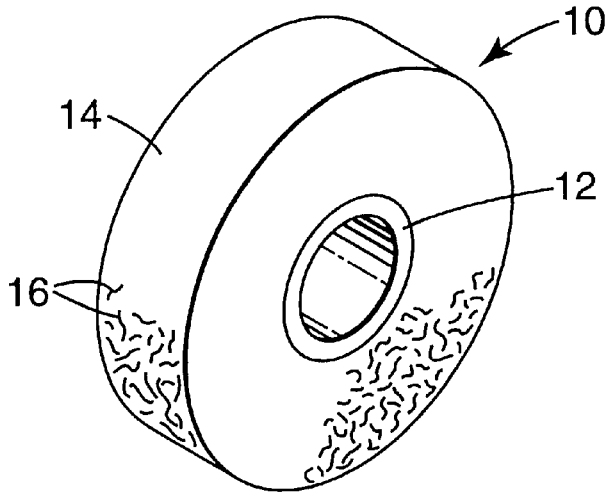
FIG. 1 is a perspective view of an abrasive wheel according to the present invention.
Figure 2:
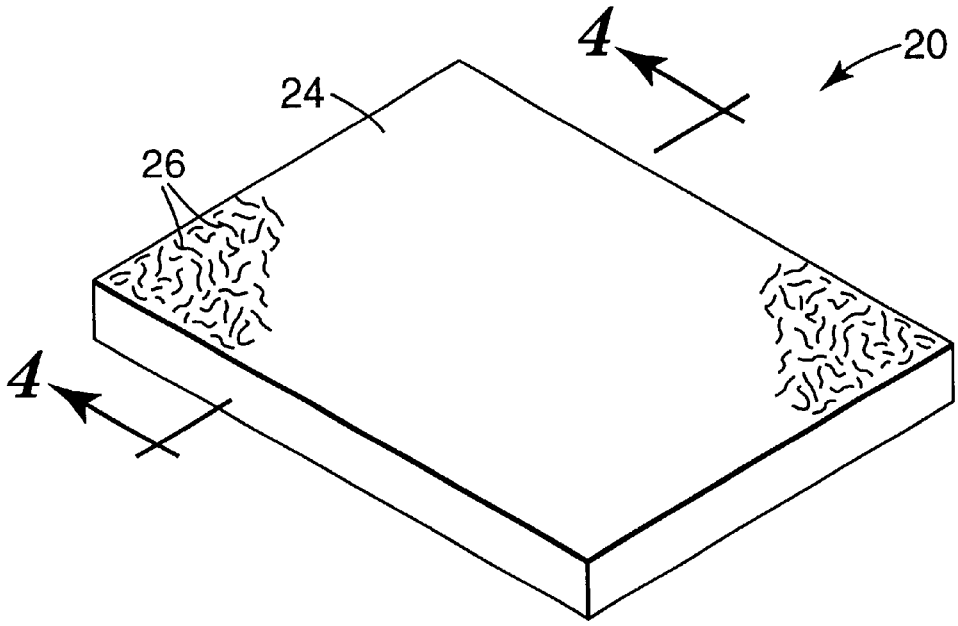
FIG. 2 is a perspective view of an abrasive block according to the present invention.
Figure 2A:
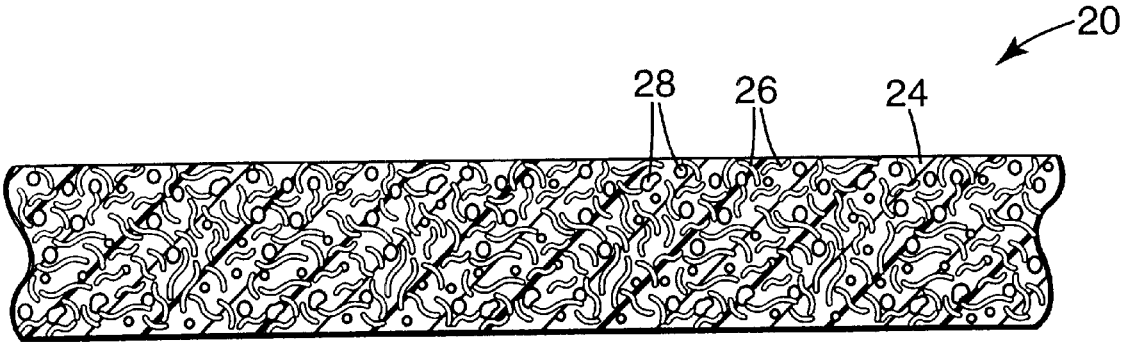
FIG. 2A is a cross sectional view of a segment of the abrasive block depicted in FIG. 2 taken along line 4—4.
Figure 3:
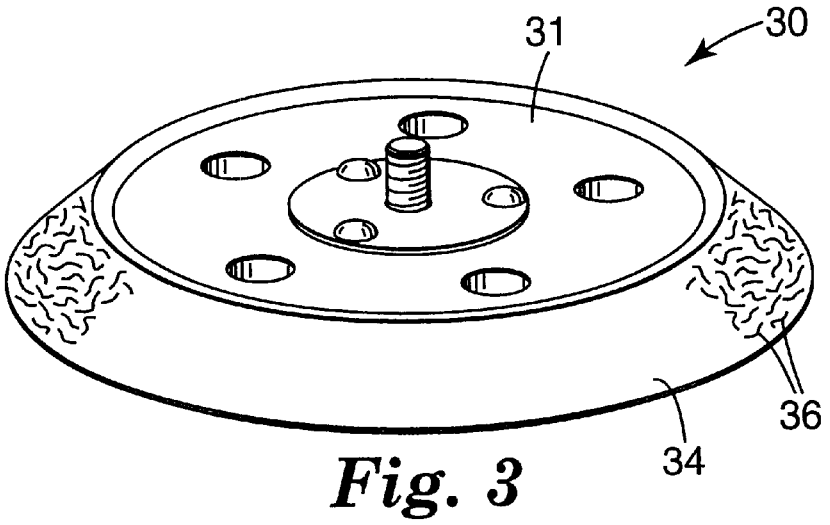
FIG. 3 is a perspective view of an abrasive disc according to the present invention.

Abrasive article articles can be in any of a variety of shapes and configurations known in the art, including wheels, blocks, disks, and belts. Referring to FIG. 1, abrasive wheel according to the present invention 10 is comprised of inner ring core 12, cellular polymeric material 14, and abrasive agglomerates 16. In FIGS. 2 and 2A, abrasive block according to the present invention 20 is comprised of cellular polymeric material 24, abrasive agglomerates 26, and voids 28. Further, for example, FIG. 3, shows abrasive disc according to the present invention 30 is comprised of attachable backing plate 31, cellular polymeric material 34, and abrasive agglomerates 36.

Materials for making cellular polymeric materials, including cellular polyurethane materials, are known in the art. Cellular polyurethane materials can be made, for example, by reacting isocyanate-functional moieties (with a functionality of 2 or greater) (e.g., a polyisocyanate) with materials reactive with isocyanate-functional moieties, (e.g. hydroxy-functional materials) with a functionality of 2 or greater) e.g., a polyol), a blowing agent (e.g., water). Isocyanate-functional materials and isocyanate-functional reactive materials vary widely in equivalent weight. Hence, the reaction stoichiometry is based on the isocyanate index (the equivalents of isocyanate functional moieties divided by the equivalents of the isocyanate reactive-functional moieties (e.g. polyol or water), times one hundred), so that an isocyanate index of 100 means a stoichiometric balance (i.e., that one isocyanate functionality has one isocyanate reactive functionality with which to react).

For preferred abrasive articles according to the present invention, there are, by weight, typically 1 part of polymer per 2 parts of abrasive agglomerate particles.

The voids of the cellular polymeric material may be isolated (i.e., "closed cell") and/or they may be intercommunicating (i.e., "open cell"). The cellular polymeric material may be flexible or rigid. Abrasive articles according to the present invention preferably have at least 25 percent void volume, more preferably at least 45 percent void volume, or even in the range from 50 to 85 percent void volume, wherein the percent void volume is a calculated value equal to the difference between the article volume and the sum of the material solids volume fractions of the various components, divided by the article volume, times 100%.

In another aspect, abrasive articles according to the present invention preferably are further comprised of lubricant (e.g., metallic salts of fatty acids, solid lubricants, esters of fatty acids, mineral oils and waxes, and poly (dimethylsiloxane) gums).

Preferably, the cellular polymeric material comprises polyurethane. The term "polyurethane" as used includes true polyurethanes, true polyureas, polyurea urethanes, and polyurethane ureas. Polyurethane can be prepared by combining and reacting components comprising polyol and polyisocyanate. For some embodiments a preferred polyurethane can be prepared by combining and reacting components comprising saturated polyol, saturated polyisocyanate, and a free radical source (e.g., peroxide).

Polyols

As used herein, "polyol" refers to hydroxy-functional materials having a hydroxy functionality of at least 2. Suitable polyols include polyester polyols and polyether polyols, and polydiene polyols. Useful polyester diols include those based on the condensation of diacids such as adipic; glutaric and phthalic acids with diols such as ethylene glycol; 1,2-propylene glycol; 1,3-propylene glycol; 1,4-butanediol; diethylene glycol; neopentyl glycol; 1,6-hexanediol and dipropylene glycol. Useful polyester triols include those based on condensation of the above in combination with triols such as trimethylolpropane or glycerin. Other useful polyester polyols include polycaprolactone polyols based on the polymerization of gamma-caprolactone with di and trifunctional starters.

Useful polyether polyols include polyethylene glycol; polypropylene glycol; polytetramethylene glycol and their copolymers and blends and polypropylene glycol triols incorporating trifunctional starters such as glycerol or trimethylolpropane.

Suitable polyols also include polyols chain-extended with a less than stoichiometric quantity of difunctional isocyanate to give a hydroxy-functional polyurethane oligomer.

Other examples of polyols include short chain diols and triols such as ethylene glycol; diethylene glycol; dipropylene glycol; 1,4-butanediol; 1,4-cyclohexane dimethanol; neopentyl glycol; 1,6-hexanediol; hydroquinone bis(2-hydroxyethyl) ether; resorcinol bis(2-hydroxyethyl) ether; triethanolamine. Such short chain diols and triols may be used, for example, in combination with longer chain polyols to give improved mechanical properties. In addition, amines may be incorporated into polyol to modify properties. Examples of such amines include those available from Albemarle Corp., Baton Rouge, La. under the trade designations "ETHACURE 100" and "ETHACURE 300", and from Air Products, Allentown, Pa. under the trade designation "VERSALINK 1000".

Polyols include saturated polyols (or "non-olefinic polyols"). "Saturated polyols" refer to hydroxy-functional materials having a hydroxy functionality of at least 2, and exhibits a negative response to a classic bromine test for unsaturation, wherein dropwise addition of the polyol to an aqueous bromine solution does not cause rapid decolorization.

Sources of polyol for making abrasive articles according to the present invention are known in the art, and include that commercially available, for example, from Polyurethane Corporation of America (Polyurethane Specialties Company, Inc.), Lyndhurst, N.J., under the trade designation "MILLOXANE 7209A" as part of a preformulated foam system. (This system also includes as polyisocyanate, similarly available under the trade designation "MILLOXANE 7209B"). As used herein, "preformulated" means that a composition includes not only the primary reactive component(s), but also has adjuvants such as stabilizers, catalysts, and blowing agents optimized to produce a desired reaction product.

As used herein, "polyisocyanate" refers to isocyanate-functional materials having an isocyanate functionality of at least 2. Suitable polyisocyanates include those based on diphenylmethane 4,4'-diisocyanate (4,4' MDI), diphenylmethane 2,4'-diisocyanate (2,4' MDI), diphenylmethane 2,2'-diisocyanate (4,4' MDI) and their mixtures as well as oligomers and modified forms such as carbodiimides, allophanates, as well as prepolymers and pseudo-prepolymers formed by complete or partial reaction with polyols to give isocyanate functional oligomers alone or in combination with free isocyanate, as well as isocyanates based on toluene 2,4-diisocyanate (2,4 TDI), toluene 2,6-diisocyanate (2,6 TDI) and mixtures of these two; prepolymers and pseudo-prepolymers formed by the complete or partial reaction with polyols to give isocyanate functional urethane oligomers alone or in combination with free isocyanate.

Polyisocyanates include saturated polyisocyanates (or "non-olefinic polyisocyanates"). "Saturated polyisocyanates" refer to isocyanate-functional materials having an isocyanate functionality of at least 2, that exhibits a negative response to a classic bromine test for unsaturation, wherein dropwise addition of the polyisocyanate to an aqueous bromine solution does not cause rapid decolorization, after the isocyanate functionality has been reacted with trimethylamine and ethanol to render the isocyanate further unreactive. Aromatic isocyanates are not considered to be unsaturated for the purposes of this disclosure.

Sources of polyisocyanate for making abrasive articles according to the present invention are known in the art, and include that commercially available, for example, from Polyurethane Corporation of America (Polyurethane Specialties Company, Inc.), Lyndhurst, N.J., under the trade designation "MILLOXANE 7209B" as part of a preformulated foam system. This system also includes saturated polyol under the trade designation "MILLOXANE 7209A."

Optionally, abrasive articles according to the present invention may comprise a free radical source. Suitable free radical sources include organic peroxides, azo compounds, persulfate compounds, and combinations thereof. Free radicals generated by actinic or ionizing radiation may also be employed for abrasive articles having suitably small dimensions or effective transparency.

Preferred amounts of free radical source materials are in the range from about 0.1% to about 10% (more preferably, in the range from about 1% to about 5%) by weight of the polymeric reaction product of saturated polyol and saturated polyisocyanate.

Suitable organic peroxides include t-butyl peroxyisobutyrate; acetyl peroxide; lauroyl peroxide; benzoyl peroxide; p-chlorobenzoyl peroxide; hydroxyheptyl peroxide; cyclohexanone peroxide; di-(t-butyl) diperphthalate; t-butyl peracetate; t-butyl perbenzoate; dicumyl peroxide; t-butyl hydroperoxide; methyl ethyl ketone peroxide; di-(t-butyl) peroxide; pinane hydroperoxide; cumene hydroperoxide; t-butyl peroxy-2-ethyl hexanoate; 1,1'-bis (t-butylperoxy)-3,3,5-trimethylcyclohexane; 2,5-dimethyl-2,5-di(t-butylperoxy)hexane; 2,5-dimethylhexane 2,5-dihydroperoxide; dicetyl peroxydicarbonate; di(4-t-butylcyclohexyl) peroxydicarbonate; t-butylperoxypivalate.

Suitable azo compounds include 2,2'-azobis(4-methoxy-2,4-dimethylvaleronitrile); 2,2'-azobis(2-amidinopropane) dihydrochloride; 2,2'-azobis(2,4-dimethylvaleronitrile; 2,2'-azobis(isobutyronitrile); 2,2'-azobis(2-methylbutyronitrile); 1,1'-azobis(1-cyclohexanecarbonitrile); 2,2'-azobis(methyl isobutyrate). Suitable persulfate initiators include potassium, sodium or ammonium persulfate, alone or in combination with reducing agents such as bisulfites. Other suitable free radical sources may be apparent to those skilled in the art after reviewing the present disclosure.

The abrasive agglomerate particles are comprised of abrasive grains and a polymeric matrix formed from a radiation curable polymerizable binder precursor, wherein the abrasive agglomerate particles have a substantially constant cross-sectional area and a crush strength greater than 1 lb. (0.454 kg). The abrasive agglomerate particles can be made by forming abrasive agglomerate precursor particles, which are in turn cured. Preferably, abrasive agglomerate precursor particles are formed by forcing a composition comprising the radiation curable polymerizable binder precursor and abrasive grains through a perforated substrate. The resulting abrasive agglomerate precursor particles are separated from the perforated substrate and irradiated with radiation energy to provide the abrasive agglomerate particles. Preferably, the forcing, separating and irradiating steps are spatially oriented in a vertical and consecutive manner, and are performed in a sequential and continuous manner. In another aspect, the abrasive agglomerate particles are preferably solidified and handleable after the irradiation step, and before being collected.

The grade and type of abrasive grains and binder can be selected or varied to provide a variety of binder hardnesses and agglomerate breakdown characteristics.

The radiation curable polymerizable binder precursors may also be thermally curable as well. Preferred radiation curable polymerizable binder precursors include epoxy resins, acrylated urethane resins, acrylated epoxy resins, ethylenically unsaturated resins, aminoplast resins having pendant unsaturated carbonyl groups, isocyanurate derivatives having at least one pendant acrylate group, isocyanate derivatives having at least one pendant acrylate group or combinations thereof.

Optionally, the agglomerate particles further comprise an inorganic binder precursor and/or modifying additive. Examples of such inorganic binder precursor additive include glass powder, frits, clay, fluxing minerals, silica sols, and combinations thereof. Examples of such modifying additives include coupling agents, grinding aids, fillers, surfactants, lubricants, and combinations thereof. Examples of lubricants for making the abrasive agglomerate particles include metallic salts of carboxylic acids (e.g., lithium stearate and zinc stearate), solid lubricants (e.g., (poly) tetrafluoroethylene (PTFE), graphite, and molybdenum disulfide), poly(dimethylsiloxane) gum, and combinations thereof.

Examples of grinding aids for making the abrasive agglomerate particles include waxes, organic halide compounds, halide salts, and metals. Such grinding aids, and commercial sources thereof, are known in the art. Other suitable grinding aids may be apparent to those skilled in the art after reviewing the present disclosure. The organic halide compounds will typically break down during abrading and release a halogen acid or a gaseous halide compound. Examples of such materials include chlorinated waxes like tetrachloronaphtalene, pentachloronaphthalene, and polyvinyl chloride. Examples of halide salts include sodium chloride, potassium cryolite, sodium cryolite, ammonium cryolite, potassium tetrafluoroboate, sodium tetrafluoroborate, silicon fluorides, potassium chloride, and magnesium chloride. Examples of metals include, tin, lead, bismuth, cobalt, antimony, cadmium, and iron titanium. Other grinding aids include sulfur, organic sulfur compounds, graphite, and metallic sulfides. It is also within the scope of the present invention to use a combination of different grinding aids. The preferred grinding aid is cryolite; the most preferred grinding aid is potassium tetrafluoroborate ($KBF_4$).

Examples of coupling agents include silanes such as gamma-aminopropyltriethoxysilane; N-beta(aminoethyl)-gamma-aminopropyltrimethoxysilane; 3-methacryloxypropyltrimethoxysilane; triacetoxyvinylsilane; vinyltriethoxysilane; 3,4-epoxycyclohexylmethyltrimethoxysilane; gamma-glycidoxypropyltrimethoxysilane. Commercial sources of silane coupling agents include Dow Corning, Midland, Mich. Other useful coupling agents include titanates such as isopropyl triisostearoyl titanate; isopropyl tri(lauryl-myristyl) titanate; isopropyl isostearoyl dimethacryl titanate; isopropyl tri(dodecylbenzenesulfonyl) titanate; isopropyl tri (diisooctylphosphato) tri(dioctylpyrophosphato) titanate; isopropyl triacryloyl titanate. Commercial sources of titanate coupling agents include Kenrich Petrochemicals, Bayone, N.J.

Examples of fillers include calcium carbonate, silica, barium sulfate, titanium dioxide, feldspar, kaolin clay, magnesium silicate, and talc.

Sources, including commercial sources, of coupling agents, grinding aids, fillers, surfactants, lubricants, are known in the art. Other suitable coupling agents, grinding aids, fillers, surfactants, lubricants, may be apparent to those skilled in the art after reviewing the present disclosure.

Preferred abrasive grain sizes typically are in the range from about ANSI grade 60 to about JIS grade 8000 (about 250 micrometers to about 1 micrometer), although sizes outside this range may also be useful. Typically, the abrasive particles have a Moh's hardness of at least 5, 6, 7, 8, 9, or even 10. Suitable abrasive grains include fused aluminum oxide (including white fused alumina, heat-treated aluminum oxide and brown aluminum oxide), silicon carbide (including green silicon carbide), boron carbide, titanium carbide, diamond, cubic boron nitride, garnet, tripoli (microcrystalline $SiO_2$), chromium oxide, cerium oxide, fused alumina-zirconia, and sol-gel-derived abrasive particles, and the like. The sol-gel-derived abrasive particles may be seeded or non-seeded. Likewise, the sol-gel-derived abrasive particles may be randomly shaped or have a shape associated with them, such as a rod or a triangle. Examples of sol gel abrasive particles include those described U.S. Pat. Nos. 4,314,827 (Leitheiser et al.), 4,518,397 (Leitheiser et al.), 4,623,364 (Cottringer et al.), 4,744,802 (Schwabel), 4,770,671 (Monroe et al.), 4,881,951 (Wood et al.), 5,011,508 (Wald et al.), 5,090,968 (Pellow), 5,139,978 (Wood), 5,201,916 (Berg et al.), 5,227,104 (Bauer), 5,366,523 (Rowenhorst et al.), 5,429,647 (Larmie), 5,498,269 (Larmie), and 5,551,963 (Larmie), the disclosures of which are incorporated herein by reference. Additional details concerning sintered alumina abrasive particles made by using alumina powders as a raw material source can also be found, for example, in U.S. Pat. Nos. 5,259,147 (Falz), 5,593,467 (Monroe), and 5,665,127 (Moltgen), the disclosures of which are incorporated herein by reference. Other suitable abrasive grains may be apparent to those skilled in the art after reviewing the present disclosure.

The abrasive agglomerates can contain 100% of a particular type and/or grade of abrasive grain, or blends thereof. If there is a blend of abrasive grains, the abrasive grain types forming the blend may be of the same size. Alternatively, the abrasive grain types may be of different particle sizes.

Typically, the abrasive agglomerates are comprised of 5% to 95%, by weight, more typically, 40% to 95%, by weight, abrasive grains, based on the total weight of the abrasive agglomerates.

Preferably, the composition comprising the radiation curable polymerizable binder precursor and abrasive grains has a relatively high viscosity. In another aspect, the composition comprising the radiation curable polymerizable binder precursor and abrasive grains is 100% solids (i.e. no volatile solvents at process temperature).

Methods of forcing the composition comprising the radiation curable polymerizable binder precursor and abrasive grains through a perforated substrate include extrusion, milling, calandering, and combinations thereof. In a preferred embodiment, the method of forcing is provided by a size reduction machine such as that manufactured by Quadro Engineering Incorporated, Waterloo, Ontario, Canada.

In one embodiment, the abrasive agglomerate precursor particles are irradiated by being passed through a first curing zone which contains a radiation source. Preferred sources of radiation include electron beam, ultraviolet light, visible light, laser light, and combinations thereof. In another embodiment, the abrasive agglomerate particles are passed through a second curing zone to be further cured. Preferred energy sources in the second curing zone include thermal, electron beam, ultraviolet light, visible light, laser light, microwave, and combinations thereof.

Preferably, the abrasive agglomerate particles are filamentary shaped, and have a length ranging from about 10 micrometers to about 20 millimeters, more preferably, in the range from about 20 micrometers to about 10 millimeters, and even more preferably, in the range from about 50 micrometers to about 2.5 millimeters. Preferred filamentary abrasive agglomerate particles have diameters in the range from about 0.61 mm (0.024 inch) to about 1.9 mm (0.075 inch) and lengths in the range from about 0.61 mm (0.024 inch) to about 15 mm (0.5 inch). As such these abrasive agglomerate particles can be said to have an aspect ratio, typically referred to as L/D, where the particle can be termed as having a length to diameter ratio. The cross-sectional of the agglomerate particles can be in any of a variety of shapes, including circular or polygonal. Preferably, the cross-section of an agglomerate abrasive particle is constant.

If the formed abrasive agglomerate particles are too large, they may be reduced in size, for example, after the first irradiation step or after being passed through the second curing zone. The preferred method of size reducing is with the size reduction machine such as that manufactured by Quadro Engineering Incorporated. The size of the abrasive agglomerate particles can also be controlled, for example, by controlling the size of the abrasive agglomerate precusor particles. The size of the abrasive agglomerate precursor particles also can be controlled, for example, by the orifice size used.

The crush strength of the abrasive agglomerate particles is determined by placing 5 grams of agglomerate particles in a small paper cup and crushed by hand to reduce the length, if initially shaped as filaments. The crushed agglomerate particles are poured onto a glass plate. Only samples that are less than 100 mils (2.54 mm) in length were crushed. The force to crush the particle is measured using a Model DPP-25 crush tester obtained from Chatillon having a force gauge equipped with a flat compression fitting. The force gauge reads from 0–25 pounds. The flat compression foot of the force gauge is placed in a horizontal position above the particle to be crushed and a constant force is applied by hand until the particle breaks (audible sound and/or feel). The force required to break the particle is recorded and the test repeated on eleven other samples. The Crush Test is the average force to break the twelve particles.

For additional details regarding the abrasive agglomerate particles for making abrasive articles according to the present invention see in co-pending applications having U.S. Ser. Nos. 09/688,484, 09/688,486, and 09/688,444 (Culler et al.), filed Oct. 16, 2000, the disclosures of which are incorporated herein by reference.

Examples of lubricants for making abrasive articles according to the present invention include metallic salts of fatty acids (e.g., lithium stearate, zinc stearate), solid lubricants (e.g., (poly)tetrafluoroethylene (PTFE), graphite, and molybdenum disulfide), mineral oils, waxes, fatty acid esters (e.g. butyl stearate), poly(dimethylsiloxane) gum, and combinations thereof. Such lubricants, and commercial sources thereof, are known in the art. Other suitable lubricants may be apparent to those skilled in the art after reviewing the present disclosure.

Abrasive articles according to the present invention may further comprise diluent particles such as marble, gypsum, flint, silica, iron oxide, aluminum silicate, and glass (including glass bubbles and glass beads). For example, the abrasive article may have a diluent particle to abrasive grain ratio between 2 to 50% by weight.

Foaming agents, also known as "blowing agents", may also be used to aid in providing abrasive articles according to the present invention. Generally, preformulated polyols contain, among other things, sufficient blowing agent to cause foaming of the composition. In the event higher void volume foams are desired, additional or other blowing agents may be included such as water, low-boiling liquids (e.g., cyclopentane) and chemicals that decompose to evolve gases (e.g., azo compounds such as azodicarbonimides). Alternatively, or in addition, for example, air (or other environmental gas) may be incorporated or entrained into the composition via turbulent mixing or frothing.

Optionally abrasive articles according to the present invention may include individual abrasive grains and/or agglomerates other than specific, required abrasive agglomerate particles, as well as reinforcing fibers, fillers, and pigments (e.g., iron oxide and titanium oxide). Other optional additives include auxiliary blowing agents, such as water, which can be used to create a lower density foam. Additional details regarding other abrasive agglomerate particles may be found, for example, in U.S. Pat. Nos. 4,311,489 (Kressner), 4,652,275 (Bloecher et al.), 4,799,939 (Bloecher et al.), 5,549,962 (Holmes et al.), and 5,975,988 (Christianson), the disclosures of which are incorporated herein by reference.

Typically, the polyol is blended with optional additives such as lubricants, followed by the addition and blending in of abrasive agglomerate particles and optional additives such as pigments. The last ingredient added and blended in is typically the polyisocyanate. Other mixing orders, however, may also be useful. The specified, required abrasive agglomerate particles and optional additives such as lubricants may be dispersed in the polyol, for example, using a mixer such as that available, for example, from Morehouse-COWLES, Fullerton, Calif. under the trade designation "DISCPERSER MIXER".

The ingredients may also be blended together using a continuous mixer, where the ingredient streams are metered via metering devices (e.g., gear pumps into the mixer). The mixer preferably includes a high shear mixing blade. Continuous mixers are commercially available, for example, from Edge Sweets Company, Grand Rapids, Mich. under the trade designation "FFH MIXER". The polyol and nonabrasive optional additives may be continuously metered to a continuous mixer using, for example, a pump such as that available under the trade designation "ZENITH GEAR PUMP" from, Zenith Products Division, Sanford, N.C. Optionally the polyol and optional additives such as lubricants or abrasive additives may be continuously metered to a continuous mixer using, for example, a pump such as that available under the trade designation "MOYNO PROGRESSIVE CAVITY PUMP" (Model FC2C SSE3 DAA) from Moyno, Inc, Springfield, Ohio. Optionally, the abrasive materials may be added such that abrasive contact with pump parts is minimized. For example, the abrasive materials may be continuously metered to a continuous mixer using a single or twin screw volumetric feeder such as that available under the trade designation "K-TRON TWIN SCREW VOLUMETRIC FEEDER" (Model T 35), from K-Tron International, Inc., Pitman N.J., directly into the mixer rather than predispersing it in the saturated polyol. The polyisocyanate may be continuously metered to a continuous mixer using, for example, a pump such as that available under the trade designation "ZENITH GEAR PUMP" from, Zenith Products Division, Sanford, N.C.

Optionally, the polyol and relatively fine abrasive particles and/or fillers may be mixed together to create a "preblend" composition, wherein the abrasive particles/fillers can function to stiffen the final foam and provide additional abrasive quality to the foam. The abrasive agglomerate particles and polyisocyanate can then be added simultaneously to the polyol preblend composition and then vigorously and quickly mixed together. This blending can occur in a batch process where the final component streams are added on a weight basis into a mixing chamber and then mixed using a high shear mixer.

The blending may also occur using a continuous mixer, where the component streams are metered via metering devices (e.g., gear pumps) for the fluid streams entering the mixer, the mixer containing a high speed mixer blade and the mixed materials exit the mixer in a continuous fashion. The dry mineral stream may be added to the continuous mixer using a screw type volumetric feeder.

The abrasive articles can be formed generally using techniques known in the art, including the use of molds. For example, suitable molds for making abrasive wheels include a ring of the appropriate desired diameter and height, have a top and bottom sealing surface (mold plate), and a core pin through the center of the top and bottom plates. Suitable molds, including materials (e.g., metal, cardboard, fiberglass, phenolic, and plastic) for constructing the molds, are well known in the art. A release liner (e.g., silicone coated paper) may be used to facilitate removal of the abrasive article from the mold.

The polyol/polyisocyanate mixture typically expands during curing. Such expansion should be taken into account when selecting the selecting and filling the mold, as well as the desired void volume or density of the abrasive article.

Although not wanting to be bound by theory, it is believed that the durometer or hardness of the abrasive article is significantly affected by the abrasive grain to polymer ratio (AG/P), wherein AG includes the weight of the intra-agglomerate binder, and wherein polymer in this context refers to the cellular polymeric material. Durometer scales range from Shore A, for soft materials, to Shore D for firmer materials. For preferred articles according to the present invention, Shore A is an indicator of the conformability and hardness of the foam material.

In general, the softness, conformability, flexibility, and abrading performance of abrasive articles according to the present invention can be adjusted, for example, by adjusting the AG/P ratio. For example, as the relative amount of abrasive grains/agglomerates decreases, the abrading performance decreases, but the wheel softness and conformability increases. Conversely, as the level of abrasive grains/agglomerates is increased, the abrading performance increases, but the wheel softness and conformability decreases.

For abrasive articles according to the present invention utilizing the abrasive agglomerate particles, the abrasive article conformability, softness, and abrading performance is typically higher as compared to the same abrasive article having an equivalent weight of non-agglomerated abrasive grains. The abrasive agglomerate particles and foam are both able to erode and provide a continuous cutting surface with minimal smear of the cellular polymeric material as compared to an analogous abrasive article of an equivalent weight of non-agglomerated abrasive grains (i.e., individual abrasive grains) in an equivalent cellular polymeric material. Typically, the AG/P ratio for abrasive articles according to the present invention is in the range from about 0.5 to about 3.5. Preferably, the abrasive articles according to the present invention have a density of at least 4 g/in$^3$ (0.24 g/cm$^3$), more preferably, in the range from 4 g/in$^3$ (0.24 g/cm$^3$) to 22 g/in$^3$ (1.34 g/cm$^3$), and a Shore A durometer value of at least 10, more preferably, in the range from 10 to 95.

For articles formed with a closed mold (i.e., a mold where the foam precursor is added, and the mold sealed), overfilling the molds tends to decrease the amount of void space, which tends to lead to an increase in the cell wall thickness and general decrease in the foam conformability.

Depending on the nature of the cellular polymeric material, a curing step may be required. For example, a preferred cellular polyurethane material, a polyol/polyisocyanate mixture is typically cured with heat. For example, the mixture is typically heated to, and held at a temperature(s) in the range from about 25 to about 100° C. for several minutes to hours (more typically for about 45–60 minutes).

It is also within the scope of the present invention to use disposable mold rings and in combination with release liners to prevent the foam from sticking, for example, to the top and bottom mold plates. Such a mold set up can allow partial curing at room temperature for relatively shorter times, wherein the partially cured article, still within the disposable mold ring is removed from mold assembly, and then the cure is completed.

Optionally the mold cavity may also contain reinforcing fabrics, scrims, or mesh so as to integrally mold with the reacting mixture and become embedded in the molded abrasive article.

For some applications and cellular polymeric materials, a post-curing step may be needed. For example, for cellular polyurethane material, a free radical source may be used with the polyol and polyisocyanate curing typically takes place in two distinct stages, referred to as a "cure" and a "post cure". First, the mixture is cured (i.e., substantially formed by the reaction of the polyol and the polyisocyanate) while the mold is maintained at a first temperature. Subsequently, a second cure stage (i.e., a post cure) is accomplished by heating the article to a second temperature greater than the first temperature. At the second temperature, the free radical source provides for an additional curing step to render the article more suitable for use. The second temperature(s) is sufficiently high, and is maintained for a sufficient period time to decompose the free radical source so that the second stage cure is substantially completed. For example, the mixture is typically heated to, and held at a temperature(s) in the range from about 25° C. to about 100° C. (or a temperature that is 50° C. less than the decomposition temperature of the free radical source, whichever is less) for several minutes to hours (more typically for about 45–60 minutes).

It is also within the scope of the present invention to partially segment the abrasive article to provide a desirable property such as additional conformability. For example, this segmentation can take the form of providing radial inserts in the mold between the two mold plates and extending from the outer diameter inwards toward the core. The radial inserts provide radial spaces in the resulting molded article. The lengths of the radial inserts can change the flexural properties of the abrasive article. The segments of the abrasive wheel between the radial spaces in the molded article can increase the conformability of the abrasive wheel by forming flaps of the abrasive article. The number of radial spaces increases the conformability.

Another method of segmentation can be to have different materials in concentric rings about the core. For example, the abrasive article can have inner concentric ring of non-abrasive containing cellular polymeric material and an outer concentric ring containing abrasive material, which can result in an even more conformable abrasive wheel. The inner concentric ring of cellular polymeric material can be, for example, a die cut piece of foam inserted into the mold or a preformed molded cellular polymeric material ring.

Abrasive articles according to the present invention are typically dressed (i.e., outer skin layers of the article removed) prior to use.

Abrading with abrasive articles according to the present invention may be done dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like. Abrasive articles of the present invention may be used with externally-applied abrasive compounds, such as those known as polishing or buffing compounds.

Abrasive articles according to the present invention may be used to abrade workpieces such as aluminum and aluminum alloys, carbon steels, mild steels, tool steels, stainless steel, hardened steel, brass, titanium, glass, ceramics, wood, wood-like materials, plastics, paint, painted surfaces, organic coated surfaces and the like.

It is known in the art that for many nonwoven abrasive wheels that unless sharp workpiece edges are presented to the working surface of the nonwoven abrasive wheel, the working surface of the abrasive wheel glazes and dulls out. That is, if the nonwoven abrasive wheels is just used against a flat surface, heat and residue builds up, the abrasive wheel glaze and dulls, and the cut rate decreases dramatically. If sharp workpiece edges are present, the edges tend to cause the erosion of the nonwoven surface, presenting a fresh abrasive surface. This effect happens to a lesser extent with grinding wheels. Grinding wheels are typically very hard, rigid wheels, and are usually only suited for flat surface grinding. Setup wheels tend to be much more aggressive than nonwoven abrasive wheels, and tend to exhibit higher cut rates for variable periods of time. The active surface of a setup wheel, however, is only on the periphery of the wheel. The periphery of the wheel tends to wear rather rapidly, rendering the wheel not practical for additional cutting.

Advantages and embodiments of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

Example 1

An abrasive wheel was made as follows. A mixture was prepared by combining 80 grams of a preformulated saturated polyol (obtained under the trade designation "MILLOXANE 7209A" from Polyurethane Specialties Company Inc, Lyndhurst, N.J.) and 4.8 grams of finely divided lithium stearate lubricant. The mixture was stirred vigorously at high speed with a conventional laboratory three blade, air motor mixer.

When the lithium stearate was well dispersed, 80 grams of a preformulated saturated polyisocyanate (obtained under the trade designation "MILLOXANE 7209B" from Polyurethane Specialties Company Inc, Lyndhurst, N.J.) was added to the mixture without stirring; followed by 440 grams of abrasive agglomerate particles. The agglomerates were generally prepared as described in co-pending application having U.S. Ser. No. 09/688,444, filed Oct. 16, 2000, the disclosure of which is incorporated herein by reference.

More specifically, the abrasive agglomerates were prepared by thoroughly mixing 3865 grams of trimethylol propane triacrylate (obtained from Sartomer Co., Exton, Pa. under the trade designation "SR351"), 1658 grams of triacrylate of tris(hydroxy ethyl)isocyanurate (obtained from Sartomer Co., under the trade designation "SR368"), 27 grams of cumene hydroperoxide (obtained from Aldrich Chemical Company, Inc Milwaukee, Wis.), 189 grams of silane coupling agent (3-methacryloxypropyltrimethoxysilane; obtained from Union Carbide (now Dow Chemical) under the trade designation "A-174"), 54 grams of 2-benzyl-2-N,N-dimethylamino-1-(4-morpholinophenyl)-1-butanone (obtained from Ciba Specialty Chemicals Corp., Terrytown, N.Y. under the trade designation "IRGACURE 369"), 108 grams of amorphous silica filler (obtained from Cabot Corp., Alpharetta, Ga. under the trade designation "CAB-O-SIL") and 3811 grams of potassium tetrafluoroborate (obtained from Atotech USA, Inc., Cleveland, Ohio under the trade designation "SPEC 102") using a Toledo mixer (Model TM 60 from Toledo Scale Co., Rochester, N.Y.) set at #2 mixing speed for 10 minutes to make a premix composition.

The abrasive agglomerate slurry was prepared by mixing the premix composition with 37,260 grams of P-120 aluminum oxide abrasive grain using the same mixer set a #1 mixing speed for 20 minutes. The abrasive agglomerate slurry was processed into abrasive agglomerate particles with the aid of a size reduction machine (obtained from Quadro Engineering Incorporated, Waterloo, Ontario, Canada (Model # 197) under the trade designation "QUADRO COMIL." The size reduction machine was setup with an impeller and a fixed spacer. The slurry was introduced into the hopper of the size reduction machine while the impeller was spinning at 350 rpm. The slurry was processed through the size reduction machine set up with a conical screen having circular 1.14 mm (0.045 inch) orifices and spaced 5.1 mm (0.2 inch) from the arrow head impeller. As the slurry was forced through the openings in the conical screen by the impellers, a critical length was reached and the filamentary shaped agglomerate precursor particle separated from the outside of the screen and fell by gravity through a UV curing chamber (designed and built by Fusion UV Systems, Inc., Gaithersburg, Md.; Model #DRE 410 Q) equipped with two 600 watt "d" fusion lamps set on high power. The filamentary shaped agglomerate precursor particles were partially cured by the exposure to the UV radiation and thereby converted into a solid handleable form. The abrasive agglomerate particles were further cured in a thermal oven for 6 hours at 177° C. (350° F.). The length of the abrasive agglomerate particles after thermal curing was about 13 mm (0.5 inch) long.

The resulting composition of saturated polyol, saturated polyisocyanate, lithium stearate, abrasive agglomerates was then well mixed at high speed with the air motor mixer for about 20 seconds. The cream time for this polyurethane system, which allows sufficient time for mixing without an immediate reaction, was about 21 seconds.

The resulting mixed material was quickly and with minimal waste transferred to a steel mold having a 20.6 cm (8.125 inch) diameter, 2.5 cm (1 inch) deep cavity. A 7.6 cm (3 inch) diameter fiberglass core weighing about 50 grams had been placed in the center of the mold. A single layer of silicone coated paper had been placed in the bottom on the mold with a single layer of knit scrim (obtained under the trade designation "TA 84" from Apex Mills Corporation, Inwood, N.Y.) on top of the release paper. The mold had been pre-heated to 54° C. (130° F.). The "mixed" material was evenly distributed in the mold, another single layer of scrim had placed over the top of the mold, another release paper placed over the scrim and the mold tightly capped to maintain a closed mold during the reaction of the polyurethane system. The filled mold was placed in an oven heated to 54° C. (130° F.). After 1 hour the resulting article was removed from the mold and placed back into the same oven heated to 54° C. (130° F.) for an additional 12 hours. The resulting abrasive wheel was 2.5 cm (1 inch) thick, and had an inside diameter of 7.6 cm (3 inches) and an outside diameter of 20.6 cm (8.125 inches). The abrasive wheel weighed 636 grams, had a AG/P ratio of 2.75, a density of 0.82 g/cm$^3$ (13.5 g/in$^3$), a Shore A durometer value of 30–40, and a void volume of 62.0%.

The wheel was prepared for evaluation by first dressing the working surface of the wheels with an abrasive tool to remove the surface skin of the wheel.

Example 2

The Example 2 abrasive wheel was prepared as described in Example 1 except that the abrasive agglomerate particles were prepared using a conical forming screen with 1.91 mm (0.075 inch) circular openings. The abrasive agglomerate particles were about 1.3 cm (½ inch) long. The resulting abrasive wheel was 2.5 cm (1 inch) thick, and had an inside diameter of 7.6 cm (3 inches) and an outside diameter of 20.6 cm (8.125 inches). The abrasive wheel weighed 634 grams, had a AG/P ratio of 2.75, a density of 0.82 g/cm$^3$ (13.4 g/in$^3$), a Shore A durometer value of 30–50, and a void volume of 62.4%. The wheel was prepared for evaluation by first dressing the working surface of the wheels with an abrasive tool to remove the surface skin of the wheel.

Example 3

The Example 3 abrasive wheel was prepared as described in Example 1 except that the abrasive agglomerate particles were prepared using a conical forming screen with 1.91 mm (0.075 inch) circular openings, no lithium stearate lubricant was added, no fiberglass core was used, and no knit scrim was used. Further, the mixture was prepared using 109 grams of the preformulated saturated polyol ("MILLOXANE 7209A"), 109 grams of the preformulated saturated polyisocyanate ("MILLOXANE 7209B"), and 444 grams of the abrasive agglomerate particles. The abrasive agglomerate particles were about 1.3 cm (½ inch) long.

The resulting abrasive wheel was 2.5 cm (1 inch) thick, and had an inside diameter of 7.6 cm (3 inches) and an outside diameter of 20.6 cm (8.125 inches). The abrasive wheel weighed 552 grams, had a AG/P ratio of 2.04, a density of 0.67 g/cm$^3$ (10.9 g/in$^3$), a Shore A durometer value of 30–50, and a void volume of 67.4%.

The wheel was prepared for evaluation by first dressing the working surface of the wheels with an abrasive tool to remove the surface skin of the wheel.

Example 4

The Example 4 abrasive wheel was prepared as described in Example 1 except the abrasive agglomerate particles were prepared using a conical forming screen with 1.91 mm (0.075 inch) circular openings, less lithium stearate lubricant was added, and no knit scrim was used. Further, the mixture was prepared using 100 grams of the preformulated saturated polyol ("MILLOXANE 7209A"), 100 grams of the preformulated saturated polyisocyanate ("MILLOXANE 7209B"), 2 grams of the lithium stearate lubricant, and 400 grams of the abrasive agglomerate particles. The abrasive agglomerate particles were about 1.3 cm (0.5 inch) long.

The resulting abrasive wheel was 2.5 cm (1 inch) thick, and had an inside diameter of 7.6 cm (3 inches) and an outside diameter of 20.6 cm (8.125 inches). The abrasive wheel weighed 614 grams, had a AG/P ratio of 2.0, a density of 0.80 g/cm$^3$ (13.1 g/in$^3$), a Shore A durometer value of 50–60, and a void volume of 60.4%.

The wheel was prepared for evaluation by first dressing the working surface of the wheels with an abrasive tool to remove the surface skin of the wheel.

Example 5

The Example 5 abrasive wheel was prepared as described in Example 1 except the abrasive agglomerate particles were reduced in size. The abrasive agglomerate particles were size reduced by passing them once through the size reduction machine ("QUADRO COMIL") set up with a 109 grater screen, a 5.1 mm (0.2 inch) spacer and a arrow head impeller running at 252 rpm and then two times through the size reduction machine set up with a 79G grater screen, a 5.1 mm (0.2 inch) spacer and a arrow head impeller running at 252 rpm.

The abrasive agglomerate particles had an L/D ratio of about 1 to 2. The resulting abrasive wheel was 2.5 cm (1 inch) thick, and had an inside diameter of 7.6 cm (3 inches) and an outside diameter of 20.6 cm (8.125 inches). The abrasive wheel weighed 572 grams, had a AG/P ratio of 2.75, a density of 0.80 g/cm$^3$ (13.1 g/in$^3$), a Shore A durometer value of 28–32, and a void volume of 62.8%.

The wheel was prepared for evaluation by first dressing the working surface of the wheels with an abrasive tool to remove the surface skin of the wheel.

Example 6

The Example 6 abrasive wheel was prepared as described in Example 1 except the abrasive agglomerate particles were prepared using a conical forming screen with 1.91 mm (0.075 inch) circular openings, less lithium stearate lubricant was added, and a different scrim was used. The used was a woven scrim (obtained under the trade designation "H66" from Apex Mills Corporation, Inwood, N.Y.). Further, the mixture was prepared from 80 grams of the preformulated saturated polyol ("MILLOXANE 7209A"), 80 grams of the preformulated saturated polyisocyanate ("MILLOXANE 7209B"), 2.4 grams of the lithium stearate lubricant, and 440 grams of the abrasive agglomerate particles. The abrasive agglomerate particles were about 1.3 cm (0.5 inch) long.

The resulting abrasive wheel was 2.5 cm (1 inch) thick, and had an inside diameter of 7.6 cm (3 inches) and an outside diameter of 20.6 cm (8.125 inches). The abrasive wheel weighed 635 grams, had a AG/P ratio of 2.75, a density of 0.82 g/cm$^3$ (13.4 g/in$^3$), a Shore A durometer value of 62–65, and a void volume of 62.6%.

The wheel was prepared for evaluation by first dressing the working surface of the wheels with an abrasive tool to remove the surface skin of the wheel.

Example 7

The Example 7 abrasive wheel was made as follows. A mixture was prepared by combining 9,770 grams of the preformulated saturated polyol ("MILLOXANE 7209A"), 1077 grams of finely divided lithium stearate lubricant, 431 grams of t-butyl peroctoate (a thermally activated free radical source; obtained from AKZO Chemicals, Inc., Pasedena, Tex. under the trade name designation "TRIGONOX 21-OP050"), and 72 grams of de-ionized water. This mixture was stirred vigorously at high speed with an industrial mixer (obtained under the trade designation "COWLES DISCPERSER", from Morehouse-COWLES, Fullerton, Calif.). The mixture was pumped at a rate of 567 g/min with a gear pump (obtained under the trade designation "ZENITH GEAR PUMP" from Zenith Products Division, Sanford, N.C.) into an inlet port of the mixing head of a mixer (obtained under the trade designation "FFH MIXER" from Edge Sweets Company, Grand Rapids, Mich. The polyisocyanate ("MILLOXANE 7209B"), was pumped at a rate of 585 g/min with another gear pump ("ZENITH GEAR PUMP") into the other inlet port of the mixing head of the mixer.

The abrasive agglomerate particles were prepared as described in example 1 except that no amorphous silica filler ("CAB-O-SIL") was used in the mix, polyethylene glycol was added to the premix and the abrasive grain was green silicon carbide (having an average particle size of 11.9 micrometers; Dv50% as measured by a Multisizer; obtained under the trade designation "GC1000" from Fujimi Corporation, Elmhurst, Ill.). The premix contained 588 grams of trimethylol propane triacrylate ("SR351"), 251.7 grams of triacrylate of tris(hydroxy ethyl)isocyanurate ("SR368"), 8.1 grams of the cumene hydroperoxide, 47.5 grams of silane coupling agent ("A-174"), 13.8 grams of 2-benzyl-2-N,N-dimethylamino-1-(4-morpholinophenyl)-1-butanone ("IRGACURE 369"), 951.7 grams of potassium tetrafluoroborate, and 810 grams of polyethylene glycol (obtained under the trade designation "PEG 600" from Aldrich Chemical Co., Milwaukee, Wis.) and was mixed using a 4.7 liters (5 quart) Hobart mixer set at #1 mixing speed for 10 minutes to make the premix composition. The abrasive agglomerate slurry was prepared by mixing the premix composition with 6150 grams of green silicon carbide ("GC1000") using the same mixer set a #1 mixing speed for 30 minutes. The slurry was processed through the size reduction machine "QUADRO COMIL" set up with a conical screen having circular 0.61 mm (0.024 inch) orifices and spaced 6.4 mm (0.25 inch) from the arrow head impeller running at 300 rpm. The length of the abrasive agglomerate particles after thermal curing was about 1.3 to 2.5 mm (0.050 inch to 0.10 inch) long. The abrasive agglomerate particles had a L/D ratio about 2 to 4.

The abrasive agglomerate particles were added at a rate of about 1134 g/min to the third inlet port of the mixer using a twin screw volumetric feeder (obtained under the trade designation "K-TRON MODEL T 35", from K-Tron International, Inc., Pitman, N.J.). The mixing head combined and vigorously mixed the inlet streams.

The resulting mixed material was directed to a waste container for 60 seconds to allow the mixer to become stabilized. After 60 seconds, the mixed material was directed into a steel mold having a 31.8 cm (12.5 inch) diameter, 5.1 cm (2 inch) deep cavity for 37.3 seconds. A 12.7 cm (5 inch) diameter fiberglass core weighing about 163 grams had been placed in the center of the mold, a release paper had been placed in the bottom of the mold. The mold had been pre-heated to 54° C. (130° F.). The "mixed" material was evenly distributed in the mold and a release paper placed over the top of the mold. The mold was then tightly capped to maintain a closed mold during the reaction of the polyurethane system. The filled mold was placed in an oven heated to 54° C. (130° F.). After 1 hour the abrasive article was removed from the mold and was placed in an oven heated to 110° C. (230° F.) for an additional 6 hours.

The resultant abrasive article was 5.1 cm (2 inches) thick and had an inside diameter of 12.7 cm (5 inches) and an outside diameter of 31.8 cm (12.5 inches). The abrasive wheel weighed 1540 grams, had an AG/P ratio of 0.42, a density of 0.42 g/cm$^3$ (6.9 g/in$^3$), a Shore A durometer value of 42, and a void volume of 74.2%.

The wheel was prepared for evaluation by first dressing the working surface of the wheel with an abrasive tool to remove the surface skin of the wheel.

Example 8

The Example 8 abrasive wheel was made as follows. The preformulated saturated polyol ("MILLOXANE 7209A") was pumped at a rate of 304 g/min with a gear pump ("ZENITH GEAR PUMP") into an inlet port of the mixing head of a mixer ("FFH MIXER"). The preformulated saturated polyisocyanate ("MILLOXANE 7209B"), was pumped at a rate of 304 g/min with another gear pump ("ZENITH GEAR PUMP") into the other inlet port of the mixing head of the mixer.

The abrasive agglomerate particles were prepared as described in Example 1, except a conical forming screen with 1.91 mm (0.075 inch) circular openings was used, and the size of the abrasive agglomerates were reduced. The abrasive agglomerate particles were size reduced by running the thermally cured particles of Example 2 once through the size reduction machine ("QUADRO COMIL") set up with a 109 grater screen, a 5.1 mm (0.2 inch) spacer and a arrow head impeller running at 252 rpm and then twice through the size reduction machine set up with a 79G grater screen, a 5.1 mm (0.2 inch) spacer and a arrow head impeller running at 252 rpm. The abrasive agglomerate particles had an L/D ratio about 1 to 2. The abrasive agglomerate particles were added at a rate of about 1504 g/min to the third inlet port of the mixer using a twin screw volumetric feeder ("K-TRON MODEL T 35"). The mixing head combined and vigorously mixed the inlet streams.

The resulting mixed material was directed to a waste container for 60 seconds to allow the mixer to become stabilized. After 60 seconds, the mixed material was directed into a steel mold having a 20.6 cm (8.125 inch) diameter, 5.1 cm (2 inch) deep cavity for 33.8 seconds. A 7.6 cm (3 inch) diameter fiberglass core weighing about 163 grams had been placed in the center of the mold, a release paper had been placed in the bottom of the mold. The mold had been pre-heated to 54° C. (130° F.). The "mixed" material was evenly distributed in the mold and a release paper placed over the top of the mold. The mold was then tightly capped to maintain a closed mold during the reaction of the polyurethane system.

The resulting abrasive wheel was 5.1 cm (2 inches) thick and had an inside diameter of 7.6 cm (3 inches) and an outside diameter of 20.6 cm (8.125 inches). The abrasive wheel weighed 1295 grams, had a AG/P ratio of 2.47, had a density of 0.85 g/cm$^3$ (13.9 g/in$^3$), Shore A durometer value of 60–65, and void volume of 60.2%.

The wheel was prepared for evaluation by first dressing the working surface of the wheels with an abrasive tool to remove the surface skin of the wheel.

Example 9

Example 9 was prepared as described for Example 8, except the flow rate of the agglomerate abrasive particles from the continuous mixer was 1666 g/min. The preheated open steel mold was filled for 35.7 seconds. The "mixed" material was evenly distributed in the mold and a release paper placed over the top of the mold. The mold was then tightly capped to maintain a closed mold during the reaction of the polyurethane system.

The filled mold was placed in an oven heated to 54° C. (130° F.). After 1 hour the abrasive article was removed from the mold and placed in an oven heated to 54° C. (130° F.) for an additional 6 hours.

The resulting abrasive wheel was 5.1 cm (2 inches) thick and had an inside diameter of 7.6 cm (3 inches) and an outside diameter of 20.6 cm (8.125 inches). The abrasive wheel weighed 1331 grams, had a AG/P ratio of 2.74, had a density of 0.87 g/cm$^3$ (14.2 g/in$^3$), Shore A durometer value of 65–70, and void volume of 60.0%.

The wheel was prepared for evaluation by first dressing the working surface of the wheels with an abrasive tool to remove the surface skin of the wheel.

Example 10

Example 10 was prepared as described for Example 9, except the flow rate of the agglomerate abrasive particles from the continuous mixer was 1816 g/min.

The resulting abrasive wheel was 5.1 cm (2 inches) thick and had an inside diameter of 7.6 cm (3 inches) and an outside diameter of 20.6 cm (8.125 inches). The abrasive wheel weighed 1492 grams, had a AG/P ratio of 2.98, had a density of 0.99 g/cm$^3$ (16.2 g/in$^3$), Shore A durometer value of 70–75, and void volume of 55.6.

The wheel was prepared for evaluation by first dressing the working surface of the wheels with an abrasive tool to remove the surface skin of the wheel.

Example 11

Example 11 was prepared as described for Example 9, except the flow rate of the agglomerate abrasive particles from the continuous mixer was 1976 g/min.

The resulting abrasive wheel was 5.1 cm (2 inches) thick and had an inside diameter of 7.6 cm (3 inches) and an outside diameter of 20.6 cm (8.125 inches). The abrasive wheel weighed 1594 grams, had a AG/P ratio of 3.25, had a density of 1.06 g/cm$^3$ (17.4 g/in$^3$), Shore A durometer value of 75–80, and void volume of 53.2%.

The wheel was prepared for evaluation by first dressing the working surface of the wheels with an abrasive tool to remove the surface skin of the wheel.

Example 12

The Example 12 abrasive wheel was prepared as follows. A polytetramethylene ether glycol having an average active hydrogen functionality of 2 and an average molecular weight of about 2000 (obtained from Penn Specialty Chemicals Inc, Conshohoken, Pa. under the trade designation "POLYMEG 2000") was melted until fluid, in an oven heated to 50° C. A mixture was formed by combining, in a batch container, the following ingredients: 3391 grams of the melted polytetramethylene ether glycol, 10,951 grams of a hydroxy terminated polybutadiene having an average active hydrogen functionality between about 2.4 and 2.6 and an average molecular weight of about 2800 (obtained from Atochem North America Inc., Philadephia, Pa. under the trade designation "POLYBD R-45HT"), 2170 grams of 1,4-butanediol (obtained from BASF, Mount Olive, N.J.), 227 grams of diethyltoluenediamine DETDA (obtained from Albemarle Corp., Baton Rouge, La.), 91 grams of de-ionized water, 987 grams of t-butyl peroctoate ("TRIGONOX 21-OP050"), 213 grams of tetra (2,2 diallyoxymethyl)butyl-di(ditridecyl)phosphito titanate (obtained from Kenrich Petrochemicals, Inc., Bayone, N.J. under the trade designation "KR-55"), 1762 grams of mixed $C_7$, $C_9$ and $C_11$ dialkyl phthalate (obtained from BASF, Mount Olive, N.J. under the trade designation "PALATINOL 711-P"), 564 grams of silicone surfactant (obtained from Witco Corporation, Greenwich, Conn. under the trade designation "L-603"), and 46 and 16 grams, respectivley of two catalysts (obtained under the trade designations "DABCO DC-1" and "DABCO DC-2" from Air Products and Chemicals, Inc., Allentown, Pa.).

The resulting material was stirred vigorously at high speed with an industrial mixer ("COWLES DISCPERSER"). The mixture was pumped at a rate of 754 g/min with a gear pump ("ZENITH GEAR PUMP") into an inlet port of the mixing head of a mixer ("FFH MIXER").

A modified 4,4'-diphenylmethane diisocyanate (obtained from Dow Chemical Company, Midland, Mich. under the trade designation "ISONATE 143L") was pumped at a rate of 422 g/min with another gear pump ("ZENITH GEAR PUMP") into the other inlet port of the mixing head of the mixer. Abrasive agglomerate particles prepared as described in Example 1. The abrasive agglomerate particles were added at a rate of about 2679 g/min to the third inlet port of the mixer using a twin screw volumetric feeder ("K-TRON MODEL T 35"). The mixing head combined and vigorously mixed the inlet streams.

The resulting mixed material was directed to a waste container for 60 seconds to allow the mixer to become stabilized. After 60 seconds, the mixed material was directed into a steel mold having a 20.3 cm (8.0 inch) outer diameter, 2.5 cm (1 inch) deep, 3.2 cm (1.25 inch) inner diameter cavity for 17.2 seconds. A release paper had been placed in the bottom of the mold. The "mixed" material was evenly distributed in the mold and a release paper placed over the top of the mold. The mold was then tightly capped to maintain a closed mold during the reaction of the polyurethane system. After 20 minutes, the abrasive article was removed from the mold, and was placed in an oven heated to 110° C. (230° F.) for an additional 1.75 hours.

The resulting abrasive wheel was 2.5 cm (1 inch) thick and had an inside diameter of 3.18 cm (1.25 inches) and an outside diameter of 20.3 cm (8.0 inches). The abrasive wheel weighed 1540 grams, had an AG/P ratio of 2.58, a density of 1.3 g/cm$^3$ (21.3 g/in$^3$), and a Shore A durometer value of 82–92. The working surface of the wheel was dressed with an abrasive tool to remove the surface skin.

Comparative Example A

The Comparative Example A abrasive wheel was prepared as described for Example 3 except that ANSI grade P120 grit aluminum oxide abrasive grain in the same AG/P ratio was used in place of the abrasive agglomerate particles; the initial cure was for one hour at 54° C. (130° F.), and the post-cure was for 12 hours at 54° C. (130° F.). The abrasive wheel weighed 626 grams, had a density of 13.4 grams/in$^3$ (0.82 g/cm$^3$), a Shore A durometer value of 52, and a void volume of 58.7%.

The wheel was prepared for evaluation by first dressing the working surface of the wheel with an abrasive tool to remove the surface skin of the wheel.

Comparative Example B

Comparative Example B abrasive wheel was a wheel that is commercially available from the 3M Company, St. Paul, Minn. under the trade designation "3M SCOTCH-BRITE CPM WHEEL" (Grade 9A Medium). The wheel was 2.5 cm (1 inch) thick and had an inside diameter of 7.6 cm (3 inches) and an outside diameter of 20.3 cm (8 inches), and weighed 511 grams. The wheel contained ANSI grade 100 aluminum oxide abrasive, had a density of 0.74 g/cm$^3$ (12.2 g/in$^3$) and a Shore A durometer value of 75–85. This wheel is typically recommended for heavy deburring and grind-line conditioning. The wheel was prepared for evaluation by first dressing the working surface of the wheels with an abrasive tool to remove the surface skin of the wheel

Comparative Example C

Comparative Example C abrasive wheel was a wheel commercially available from the 3M Company under the trade designation "3M SCOTCH-BRITE EXL" (8A Medium Unitized Wheel). This wheel was 2.5 cm (1 inch) thick and had an inside diameter of 7.6 cm (3 inches) and an outside diameter of 20.3 cm (8 inches), and weighted 481 grams. This wheel contained a blend of ANSI grade 120/150 aluminum oxide abrasive and had a density of 0.84 g/cm$^3$ (13.8 g/in$^3$) and a Shore A durometer value of 89–90. This wheel is typically recommended for deburring and finishing metals. The wheel was prepared for evaluation by first dressing the working surface of the wheels with an abrasive tool remove the surface skin of the wheel.

Comparative Example D

Comparative Example D abrasive wheel was a cotton setup wheel prepared from a cotton buff (obtained under the trade designation "CONCENTRIC STITCHED FULL DISK BUFF", from JacksonLea, Conover, N.C.) that was comprised of layers of woven cotton fabric stacked to a thickness of about 13 mm (0.5 inch) and stitched concentrically in 5 rings, each ring of stitching spaced about 9.5 mm (0.375 inch) apart. The wheel was coated with a hot hide glue, rolled in ANSI grade 80 grit aluminum oxide and cured. The wheel had a 3.3 cm (1.25 inch) center hole to accommodate a machine tool shaft and was 13.7 cm (5.375 inch) in diameter.

Abrading Evaluation

The abrading performance of Example 1 and 2 and Comparative Example B, C, and D abrasive wheels were evaluated as follows. The dressed wheel was mounted on a motor driven shaft. 1008 cold rolled steel test coupons 2 inches wide, 11 inches long and 1/16 inch thick (5.1 cm×27.9 cm×0.16 cm) were contacted against the surface of the rotating test wheel at a controlled pressure (as measured by a Chatillon Force Gauge), and at a given surface speed of the wheel. The coupon was moved back and forth in an oscillatory fashion tangent to the rotating wheel. The test coupon was contacted with the abrasive wheel for 30 seconds, followed by 30 seconds of no contact. It took 6 seconds to move the test coupon to and from the wheel. This sequence is repeated 4 times and is a test cycle for this evaluation. The overall wheel contact time for a test cycle was 2 minutes. The test coupon oscillated at a rate of 36 traverses per minute, with a stroke length of 14.6 cm (5.75 inches). The test coupon and example wheel were weighed after each cycle. The Example 1 and 2 abrasive wheels each ran smoothly without chatter or bounce. The results are shown in Table 1, below.

TABLE 1

| Example | Wheel surface speed, m/min (ft/min.) | Cut rate g/2 min. @ an applied force of 31.2 N (7 lbs.) | Cut rate g/2 min. @ an applied force of 62.4 N (14 lbs.) | Cut rate g/2 min. @ an applied force of 89.2 N (20 lbs.) |
|---|---|---|---|---|
| 1 | 1150 (3770) | 2.65 | 9.18 | 16.53 |
| 2 | 1785 (5860) | 8.27 | 16.76 | 23.88 |
| 2 | 1150 (3770) | 1.19 | 4.56 | 8.59 |
| Comp. B | 1150 (3770) | 1.80 | 1.82 | 2.71 |
| Comp. C | 1150 (3770) | 0.03 | 0.26 | 0.26 |
| Comp. D | 768 (2520) | 5.66 | 12.01 | * |
| Comp. D | 1150 (3770) | 9.12 | * | * |

* Abrasive wheel did not withstand the abrading forces.

The abrading performance of Examples 3 and 4 and Comparative Example A was also evaluated as described above for Examples 1 and 2 and Comparative Example B–D. Some minor smearing was observed for Comparative Example A. No smearing was observed for Examples 3 and 4. The results are shown in Table 2, below.

TABLE 2

| Example | Wheel surface speed, m/min (ft/min.) | Cut rate g/2 min. @ an applied force of 31.2 N (7 lbs.) | Cut rate g/2 min. @ an applied force of 62.4 N (14 lbs.) | Cut rate g/2 min. @ an applied force of 89.2 N (20 lbs.) |
|---|---|---|---|---|
| 3 | 1150 (3770) | 1.81 | 3.74 | 6.04 |
| 4 | 1150 (3770) | 2.889 | 7.07 | 11.59 |
| Comp. A | 1150 (3770) | 0.727 | 2.461 | 1.997 |

The abrading performance of an Example 1 abrasive wheel was evaluated as follows. The dressed wheel was mounted on a motor driven shaft. A metal test coupon (1.5 inch wide, 11 inch long and 0.5 inch thick (3.8 cm×27.9 cm×1.27 cm)) was contacted against the surface of the rotating test wheel at a force (as measured by a Chatillon Force Gauge) of 62.4 N (14 lbs.). The wheel surface speed was 1150 m/min (3770 ft/min.). The coupon was moved back and forth in an oscillatory fashion tangent to the rotating wheel. The test coupon was contacted with the abrasive wheel for 30 seconds, followed by 30 seconds of no contact. It took 6 seconds to move the test coupon to and from the wheel. This sequence is a test cycle for this evaluation. The test coupon oscillated at a rate of 36 traverses per minute, with a stroke length of 14.6 cm (5.75 inches). The test coupon and wheel were weighed at intervals of 4, 8, 16, 32 and 64 cycles. Coupon weight differences are reported as "cut". The wheel weight differences are reported as "wear". Abrasive efficiency was calculated by dividing the cut by the wear. The results for evaluation on 304 stainless steel test coupons and 1008 cold rolled steel test coupons are reported in Tables 3 and 4, respectively (below).

TABLE 3

| | Time, minutes | | | | |
|---|---|---|---|---|---|
| | 2 | 6 | 14 | 30 | 62 |
| Incremental cut, (i.e., cut for each time interval), grams | 2.69 | 5.62 | 12.18 | 24.04 | 45.55 |
| Cut rate for each time interval, g/min | 1.34 | 1.41 | 1.52 | 1.50 | 1.42 |
| Cumulative cut, grams | 2.69 | 8.31 | 20.49 | 44.53 | 90.08 |
| Efficiency (cut/wear) | 11.21 | 11.47 | 12.96 | 11.56 | 11.86 |

TABLE 4

| | Time (minutes) | | | | |
|---|---|---|---|---|---|
| | 2 | 6 | 14 | 30 | 62 |
| Incremental cut, (i.e., cut for each time interval), grams | 8.01 | 9.73 | 13.78 | 22.91 | 36.02 |
| Cut rate for each time interval, g/min | 4.01 | 2.43 | 1.72 | 1.43 | 1.13 |
| Cumulative cut, grams | 8.01 | 17.74 | 31.52 | 54.43 | 90.45 |
| Efficiency (cut/wear) | 15.40 | 15.44 | 12.30 | 13.40 | 14.41 |

The abrading performance of Examples 1 and 5 abrasive wheels were evaluated as described above for Example 1 and 2 and Comparative Example B–D abrasive wheels, except the contact pressure was 89.3 N (20 lbs.). The cut rate is reported in Table 5 (below) in grams per cycle (i.e., per 2 minutes of cutting time)

TABLE 5

| Number of cycles | Example 5 | Example 1 |
|---|---|---|
| 3 | 6.47 | 5.86 |
| 4 | 7.07 | 6.51 |
| 5 | 7.00 | 6.29 |
| 6 | 7.11 | 7.19 |
| 7 | 6.77 | 7.21 |
| 8 | 7.01 | 6.75 |
| 9 | 6.71 | 7.08 |
| 10 | 6.73 | 7.72 |
| 11 | 6.37 | 7.86 |
| 12 | 6.69 | 8.50 |
| 13 | 6.43 | 7.68 |
| 14 | 6.70 | 7.72 |
| 15 | 6.45 | 7.42 |
| 16 | 6.78 | 8.19 |
| 17 | 6.73 | 7.05 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprised of filamentary abrasive agglomerate particles dispersed within cellular polymeric material which comprises a lubricant, the abrasive agglomerate particles comprised of a composition of abrasive grains and a polymeric matrix formed from a radiation curable polymerizable binder precursor, wherein the abrasive agglomerate particles have a substantially constant cross-sectional area and a crush strength greater than 1 lb. and a length in the range from about 50 micrometers to about 20 millimeters and a diameter in the range of from about 0.61 mm to about 1.9 mm.

2. The abrasive article according to claim 1 wherein the abrasive article is an abrasive wheel.

3. The abrasive wheel according to claim 2 wherein the cellular polymeric material includes cellular polyurethane.

4. The abrasive wheel according to claim 3 wherein the cellular polymeric material is at least 25 percent void volume.

5. The abrasive wheel according to claim 3 wherein the cellular polymeric material is in the range from 50% to 85% percent void volume.

6. The abrasive wheel according to claim 1 wherein the lubricant includes a lubricant selected from the group consisting of metallic salts, solid lubricants, mineral oils, and combinations thereof.

7. The abrasive wheel according to claim 1 wherein the lubricant includes a lubricant selected from the group consisting of lithium stearate, zinc stearate, poly (tetrafluoroethylene), graphite, molydisulfide, butyl stearate, (poly)dimethylsiloxane gum, and combinations thereof.

8. The abrasive wheel according to claim 3, wherein the composition has a density in the range from 4 g/in$^3$ to 22 g/in$^3$, and a Shore A durometer value in the range from 10 to 95.

9. The abrasive wheel according to claim 3, wherein the binder precursor of the abrasive agglomerate particles comprise at least one of epoxy resins, acrylated urethane resins, acrylated epoxy resins, ethylenically unsaturated resins, aminoplast resins having pendant unsaturated carbonyl groups, isocyanurate derivatives having at least one pendant acrylate group, and isocyanate derivatives having at least one pendant acrylate group.

10. The abrasive wheel according to claim 3, wherein the binder precursor further comprises a free radical initiator.

11. The abrasive wheel according to claim 3, wherein the abrasive grains comprise from 40 to 95% by weight of the composition of the abrasive agglomerate particles.

12. The abrasive article according to claim 1, wherein the binder precursor of the abrasive agglomerate particles comprises at least one of epoxy resins, acrylated urethane resins, acrylated epoxy resins, ethylenically unsaturated resins, aminoplast resins having pendant unsaturated carbonlyl groups, isocyanurate derivatives having at least one pendant acrylate group, and isocyanate derivatives having at least one pendant acrylate group.

13. The abrasive article according to claim 1, wherein the binder precursor further comprises a free radical initiator.

14. The abrasive article according to claim 1, wherein the abrasive grains comprise from 40 to 95% by weight of the composition of the abrasive agglomerate particles.

* * * * *

UNITED STATES PATENT AND TRADEMARK OFFICE

CERTIFICATE OF CORRECTION

PATENT NO. : 6,645,263 B2
DATED : November 11, 2003
INVENTOR(S) : Keipert, Steven J.

It is certified that error appears in the above-identified patent and that said Letters Patent is hereby corrected as shown below:

Title page,
Item [56], References Cited, OTHER PUBLICATIONS, insert -- filed -- preceding "Oct."
Item [57], ABSTRACT, delete "abrasive articles" following "Abrasive articles".

Column 2,
Line 4, "of one" should be -- one of --
Line 38, delete "article" preceding "articles"

Column 4,
Line 21, "as" should be -- a --

Column 6,
Line 31, " tetrachloronaphtalene" should be -- tetrachloronaphthalene --
Line 34, "tetrafluoroboate" should be -- tetrafluoroborate --

Column 7,
Line 22, insert -- in -- following "described"
Line 59, "calandering" should be -- calendering --.

Column 8,
Line 33, "precusor" should be -- precursor --.
Line 57, delete "in" following "see"

Column 10,
Line 51, delete "the selecting" following "selecting"

Column 12,
Line 3, insert -- of -- following "period"
Line 64, "wheels" should be -- wheel --
Line 65, "glaze" should be -- glazes --

Column 13,
Line 56, "Terrytown" should be -- Tarrytown --.

Column 14,
Line 1, "a" should be -- at --
Line 7, "setup" should be -- set up --
Line 47, delete "had" following "scrim"
Line 62, "wheels" should be -- wheel --

UNITED STATES PATENT AND TRADEMARK OFFICE

CERTIFICATE OF CORRECTION

PATENT NO. : 6,645,263 B2
DATED : November 11, 2003
INVENTOR(S) : Keipert, Steven J.

It is certified that error appears in the above-identified patent and that said Letters Patent is hereby corrected as shown below:

Column 15,
Line 11, 36, and 61, “wheels” should be -- wheel --

Column 16,
Line 18, “wheels” should be -- wheel --
Line 27, insert -- scrim -- following ‘The”
Line 45, “wheels” should be -- wheel --
Line 56, “Pasedena” should be -- Pasadena --

Column 17,
Line 28, “a” should be -- at --

Column 19,
Line 17, 33 and 49, “wheels” should be -- wheel --

Column 20,
Line 7, “ally” should be -- alkyl --
Line 10, delete “1” preceding dialkyl
Line 15, “respectivley” should be -- respectively --
Line 31, insert -- were -- following “particles”

Column 21,
Line 23 and 40, “wheels” should be -- wheel --
Line 33, “weighted” should be -- weighed --
Line 41, insert -- to -- following “tool”
Lines 58 and 59, “Example” should be -- Examples --

Column 22,
Lines 11 and 31, “Example” should be -- Examples --

Column 23,
Lines 31 and 32, “Example” should be -- Examples --

UNITED STATES PATENT AND TRADEMARK OFFICE

CERTIFICATE OF CORRECTION

PATENT NO. : 6,645,263 B2
DATED : November 11, 2003
INVENTOR(S) : Keipert, Steven J.

It is certified that error appears in the above-identified patent and that said Letters Patent is hereby corrected as shown below:

Column 24,
Lines 17 and 18, delete "percent"
Line 53, "carbonlyl" should be -- carbonyl --

Signed and Sealed this

Twenty-second Day of June, 2004

JON W. DUDAS
*Acting Director of the United States Patent and Trademark Office*